US005669445A

United States Patent [19]

Edwards

[11] Patent Number: 5,669,445

[45] Date of Patent: Sep. 23, 1997

[54] WELL GRAVEL PACK FORMATION METHOD

[75] Inventor: Peter J. Edwards, North Adelaide, Australia

[73] Assignee: Halliburton Energy Services, Inc., Duncan, Okla.

[21] Appl. No.: 650,509

[22] Filed: May 20, 1996

[51] Int. Cl.[6] ..... E21B 43/04

[52] U.S. Cl. ..... 166/278; 166/311

[58] Field of Search ..... 166/278, 311, 166/307, 308, 319, 373, 51

[56] References Cited

U.S. PATENT DOCUMENTS

| | | | |
|---|---|---|---|
| 3,627,045 | 12/1971 | Lebourg | 166/307 X |
| 3,721,297 | 3/1973 | Challacombe | 166/299 |
| 3,743,021 | 7/1973 | McCauley et al. | 166/311 |
| 4,658,902 | 4/1987 | Wesson et al. | 166/317 |
| 5,069,285 | 12/1991 | Nuckols | 166/311 |
| 5,127,474 | 7/1992 | Schroeder, Jr. et al. | 166/278 |
| 5,131,472 | 7/1992 | Dees et al. | 166/308 |
| 5,287,930 | 2/1994 | McGill | 166/373 |
| 5,329,998 | 7/1994 | King et al. | 166/51 |
| 5,341,880 | 8/1994 | Thorstensen et al. | 166/278 |

*Primary Examiner*—Frank Tsay
*Attorney, Agent, or Firm*—Robert A. Kent

[57] ABSTRACT

The present invention provides an improved method of formimg a gravel pack in a well and in a subterranean formation penetrated by the well. The method basically comprises the steps of placing a pipe string in the well having a selectively operable shut-off valve and gravel pack forming tools including packer connected therto, and setting the packer to seal the annulus between the well and the pipe string. A pressurized fluid is introduced into the pipe string with the shut-off valve therein closed, and the shut-off valve is opened so that the pressurized fluid surges into the well below the packer and into the formation whereby debris is cleaned from the well and formation. Gravel is then introduced below the packer into the well bore and into the formation to form a gravel pack therein.

20 Claims, 3 Drawing Sheets

WELL GRAVEL PACK FORMATION METHOD

BACKGROUND OF THE INVENTION

1. Field of the Invention

The present invention relates to an improved method of forming gravel packs in wells, and more particularly, to such a method wherein gravel blocking debris is cleaned out of the well prior to forming a gravel pack therein.

2. Description of the Prior Art

In completing oil, gas and water wells, a string of casing is often run into the well bore and cemented therein. A string of production tubing is run in the casing, and the well is perforated in one or more production zones to allow formation fluids to enter the casing. Formation fluids that flow through the perforations into the interior of the casing are produced to the surface through the production tubing.

In some completions, the well bore is not cased and an open face is established across a fluid producing formation. Such open well bore arrangements are often utilized in water wells, test wells and horizontal well completions.

During the production of formation fluids, sand from the formation is often also produced which is carried with the fluids into the well and into production equipment. The presence of formation sand in the produced fluids causes erosion damage to the tubular goods and other equipment through which the fluids flow.

In order to eliminate or reduce the production of formation sand, a sand screen is typically placed adjacent to the perforations or adjacent to an open well bore face through which fluids are produced. A packer is usually set above the sand screen and the annulus around the screen is then packed with a relatively course sand, commonly referred to as gravel, to form a gravel pack around the sand screen as well as in the perforations and/or in the producing formation adjacent the well bore for filtering sand out of the in-flowing formation fluids. In open hole gravel pack installations, the gravel pack also supports the surrounding unconsolidated formation and helps to prevent the migration of sand with produced formation fluids.

Techniques which utilize pressurized fluid surging in a well to remove debris from the well bore, perforations and producing formation have heretofore been used. That is, a fluid surge in a well has been caused by creating an instantaneous pressure drop within the well bore whereby formation fluids and debris from the formation and perforations enter the well bore and are withdrawn therefrom. More recently, a surging technique has been developed whereby a pressurized fluid is surged from the well bore into the formation which cleans debris from the well bore, perforations and/or the near well formation. This technique is described in U.S. Pat. No. 5,131,472 issued on Jul. 21, 1992 to Dees et al. As disclosed in that patent, the technique can also be used to simultaneously fracture the formation.

The above described pressurized fluid surging techniques have been effective in removing debris at the time they are performed in a well. However, when a gravel pack formation procedure is subsequently performed in the well, the pipe string in the well bore must be removed and then it or a work string must be run into the well bore having gravel pack formation tools attached thereto. During the tripping of the pipe and otherwise preparing the well for the gravel pack treatment, a fluid containing fluid loss preventing material must be maintained in the well to prevent blow-outs, etc. The fluid loss preventing material is deposited in the well bore, perforations, and in the near well formation which eliminates the benefits achieved by the previously performed fluid surge clean out procedure. That is, the fluid loss preventing material and other debris in the well bore, perforations and near well formation block gravel from being placed in desired locations, particularly in the perforations and in the formation, thereby causing the gravel pack that is formed to be less than totally satisfactory.

Thus, there is a need for an improved gravel pack formation method which includes the cleaning of gravel blocking debris from the well, perforations and/or formation after the work string having gravel pack forming tools connected thereto is run in the well.

SUMMARY OF THE INVENTION

By the present invention an improved method of forming a gravel pack in a well and in a subterranean formation penetrated by the well is provided which meets the need described above and obviates the shortcomings of the prior art. The method of the present invention basically comprises the steps of placing a pipe string in a well having a selectively operable shut-off valve and gravel pack forming tools comprising a packer, a crossover and a sand screen connected thereto, and setting the packer to seal the annulus between the well and the pipe string. A pressurized fluid is introduced into the pipe string with the shut-off valve closed so that the pressure of the fluid in the pipe string is greater than the pressure of the formation. The shut-off valve is then opened so that the pressurized fluid surges into the well and into the formation thereby cleaning gravel blocking debris from the well and formation. Gravel is thereafter introduced into the well and into the formation to form a gravel pack around the sand screen.

It is, therefore, a general object of the present invention to provide an improved method of forming a gravel pack in a well.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
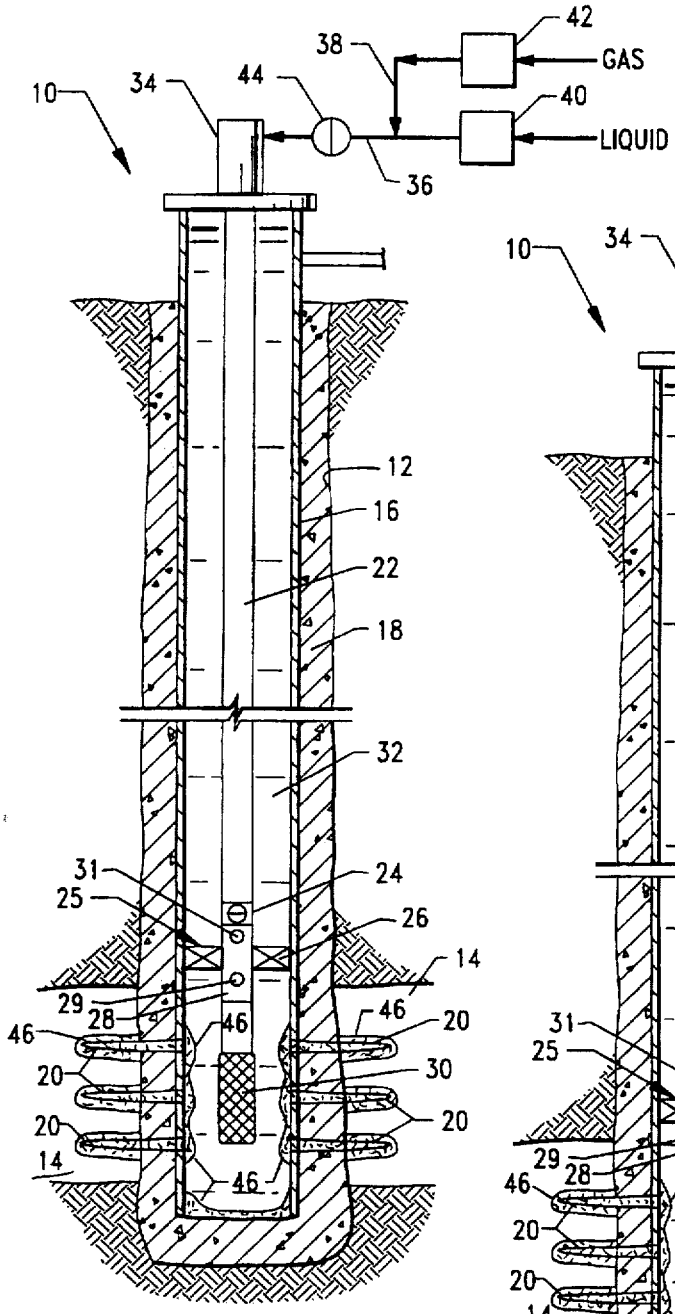
FIG. 1 is a schematic view of a cased and perforated well containing a work string having a shut-off valve and gravel pack forming tools connected thereto.

Referring now to the drawings, and particularly FIG. 1, a well 10 is schematically illustrated. The well 10 basically comprises a well bore 12 drilled in the earth which intersects a fluid producing formation 14. A casing string 16 is disposed in the well bore 12 which is bonded therein by a cement sheath 18.

The well 10 includes a plurality of perforations 20 which communicate with the fluid producing formation 14. That is, the perforations 20 extend through the casing 16 and the cement sheath 18 into the formation 14 as illustrated in the drawings.

A work string 22, also referred to as a pipe string, is disposed in the well 10 within the casing 16 thereof which extends from the surface to the fluid producing formation 14. The work string 22 includes a selectively operable shut-off valve 24 connected thereto at the lower end thereof and gravel pack forming tools generally designated by the numeral 25 are connected to the work string below the valve 24. The gravel pack forming tools are conventional and include at least a packer 26, a crossover 28 and a sand screen 30.

The selectively operable shut-off valve 24 can be any remotely operable shut-off valve which will withstand high pressure differentials. For example, the shut-off valve 24 can be a high pressure valve which can be opened or closed by movement of the work string 22, or by applying a predetermined fluid pressure to the valve by way of the work string 22 or by way of the annulus 32 between the work string 22 and the interior of the casing 16.

The gravel pack forming tools 25 and their use are well known to those skilled in the art. The work string 22 and tools 25 are placed in the well 10 such that the sand screen 30 is positioned adjacent the producing formation 14 and the perforations 20 extending thereinto. The packer 26 is set by pipe movement or other procedure whereby the annulus 32 is sealed. The crossover 28, which can support the packer 26, is a subassembly which by pipe movement or other procedure selectively allows fluids to flow from inside the work string 22 to the annulus 32 below the packer 26 by way of one or more ports 29 or vice versa, and from outside the sand screen 30 below the packer 26 through the screen 30 and the crossover 28 to the annulus 32 above the packer 26 by way of one or more ports 31 or vice versa. The crossover 28 also permits the introduction of pressurized fluid into the gravel pack after it is formed to squeeze gravel into the perforations and formation followed by the reversal of fluid out of the work string 22. The sand screen 30 connected below the crossover 28 prevents gravel from entering the work string and facilitates the separation of sand from the formation fluids produced by the well 10.

The work string 22 is connected by way of a well head 34 and conduits 36 and 38 to pumps 40 and 42. The pumps 40 and 42 are designed to pump liquid, liquid having solid particles suspended therein, gas and mixtures of gas and liquid at high pressures into the work string 22 and formation 14 by way of the crossover 28. A shut-off valve 44 is disposed in the conduit 36.

Figure 2:
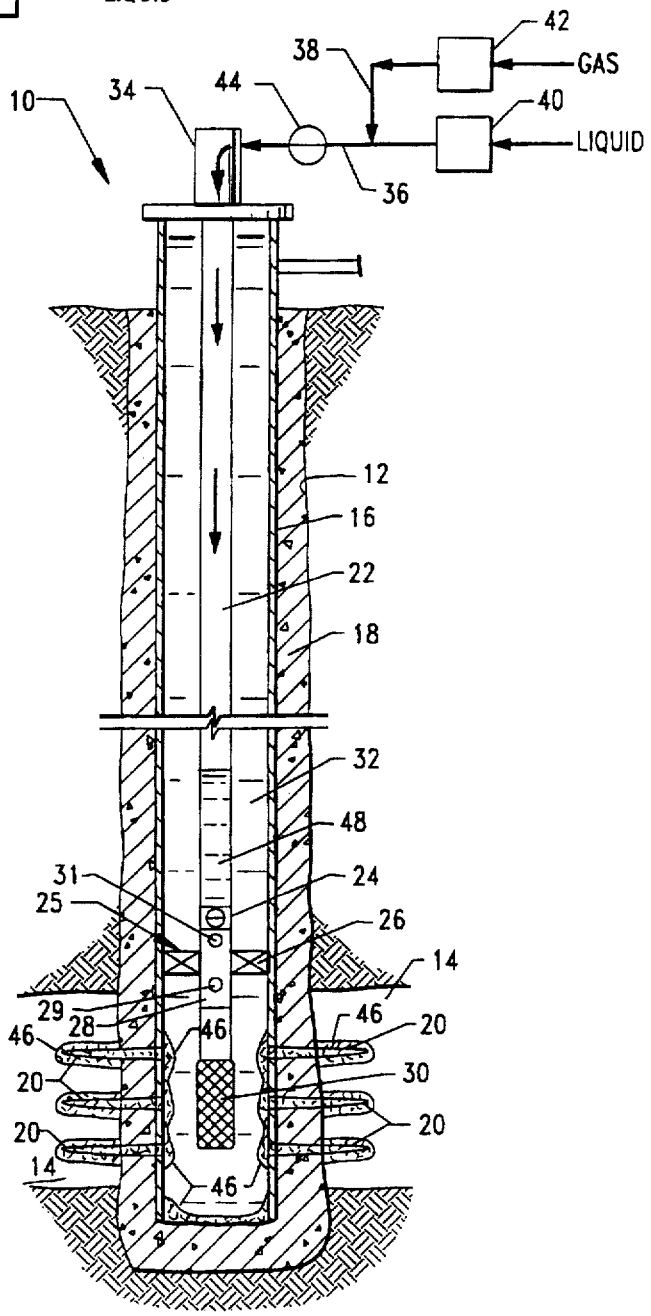
FIG. 2 is a schematic view of the well of FIG. 1 having a pressurized fluid introduced into the work string.

As shown in FIGS. 1 and 2, as a result of drilling the well bore 12, running and cementing the casing 16 in the well bore 12 and forming the perforations 20, the well 10, perforations 20 and portions of the formation 14 contain debris generally designated by the numeral 46. Most of the debris 46 is located within the casing 16 adjacent the perforations 20, within the perforations 20 and in the formation 14 near the perforations 20. The debris 46 is generally comprised of solid cement particles, fluid loss preventing materials, partially dehydrated gelled drilling and completion fluids and the like. Unless removed, the debris 46 blocks gravel from entering the perforations and generally hinders the formation of a gravel pack within the casing 16, the perforations 20 and the near well portions of the formation 14.

The method of the present invention for forming a gravel pack effective in separating sand from formation fluids is basically comprised of the steps of placing the work string 22 having the shut-off valve 24 and gravel pack formation tools 25 attached thereto into the well 10, and setting the packer 26 of the tools 25 as shown in FIG. 1. A pressurized fluid is introduced into the work string 22 with the shut-off valve 24 closed so that the pressure of the fluid in the pipe string 22 is greater than the pressure within the formation 14. The shut-off valve 24 is next opened so that the pressurized fluid surges into the well 10 below the packer 26 and into the formation 14 thereby cleaning gravel blocking debris from the well 10, the perforations 20 and the near well portions of the formation 14. Thereafter, gravel is introduced below the packer 26 into the well 10 and into the formation 14 to form a gravel pack around the sand screen, in the perforations 20 and in the formation 14.

More specifically and referring to FIGS. 1 and 2, after the work string 22 and tools 25 have been placed in the well 10, the packer 26 of the well tools 25 has been set as shown in FIG. 1 and the crossover 28 has been operated to open the ports 29 while the ports 31 remain closed, a pressurized fluid is introduced into the work string 22 as shown in FIG. 2. That is, the valve 44 is opened and one or more fluids are pumped by the pump 40 and/or the pump 42 through the conduit 36 and/or the conduit 38, the valve 44 and the well head 34 into the work string 22. Preferably, a quantity of liquid 48 is first pumped into the work string 22 followed by pressurized gas to raise the pressure within the work string 22 to a level above the fracture gradient of the formation 14. While a variety of liquids and gases can be utilized, the liquid is preferably selected from the group consisting of aqueous liquids and hydrocarbon liquids and the gas is preferably selected from the group of nitrogen, carbon dioxide and hydrocarbon gases.

Figure 3:
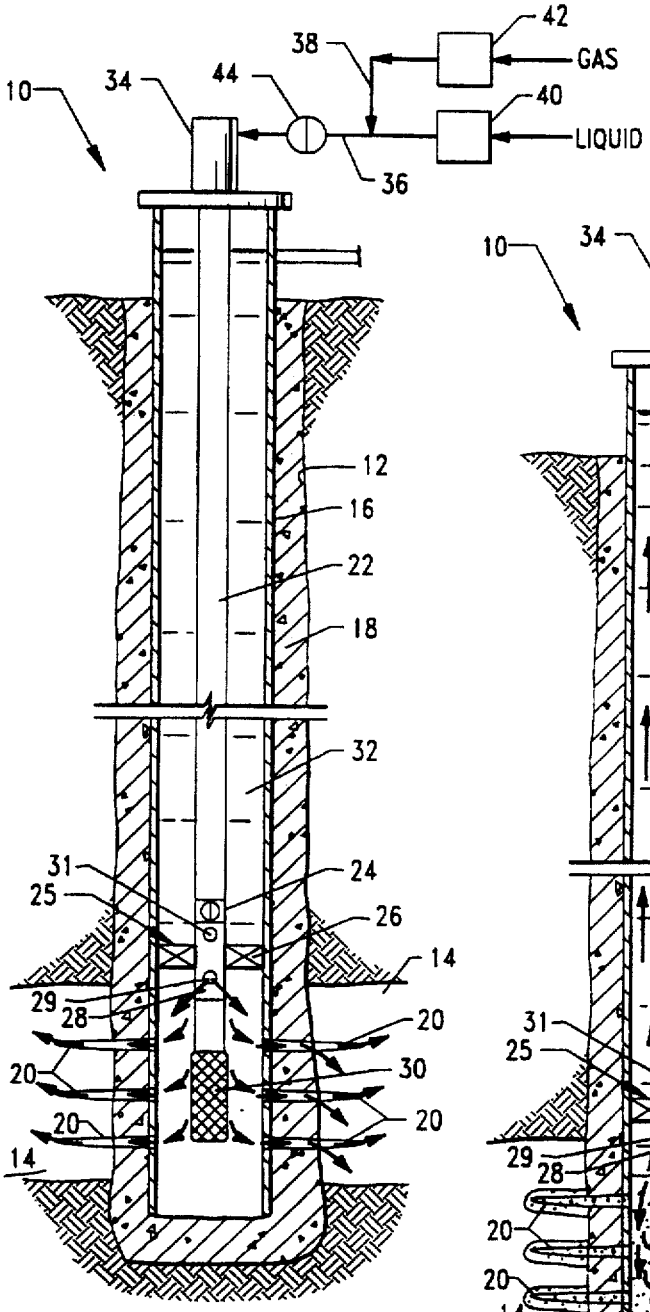
FIG. 3 is a schematic view of the well of FIG. 1 after a pressurized fluid has been introduced into the work string and the shut-off valve has been opened whereby the pressurized fluid surges through the well bore and perforations into the formation.

Once the work string 22 has been pressured up with the shut-off valve 24 closed, the shut-off valve 24 is opened which causes the pressurized fluid within the work string 22 to surge into the well 10 below the packer 26 by way of the ports 29 of the crossover 28, through the perforations 20 and into the formation 14 as shown in FIG. 3. The surge of liquid and gas through the well 10, the perforations 20 and formation 14 causes the debris 46 to be cleaned out of the well 10 and perforations 20 and forced into the formation 14.

Figure 4:
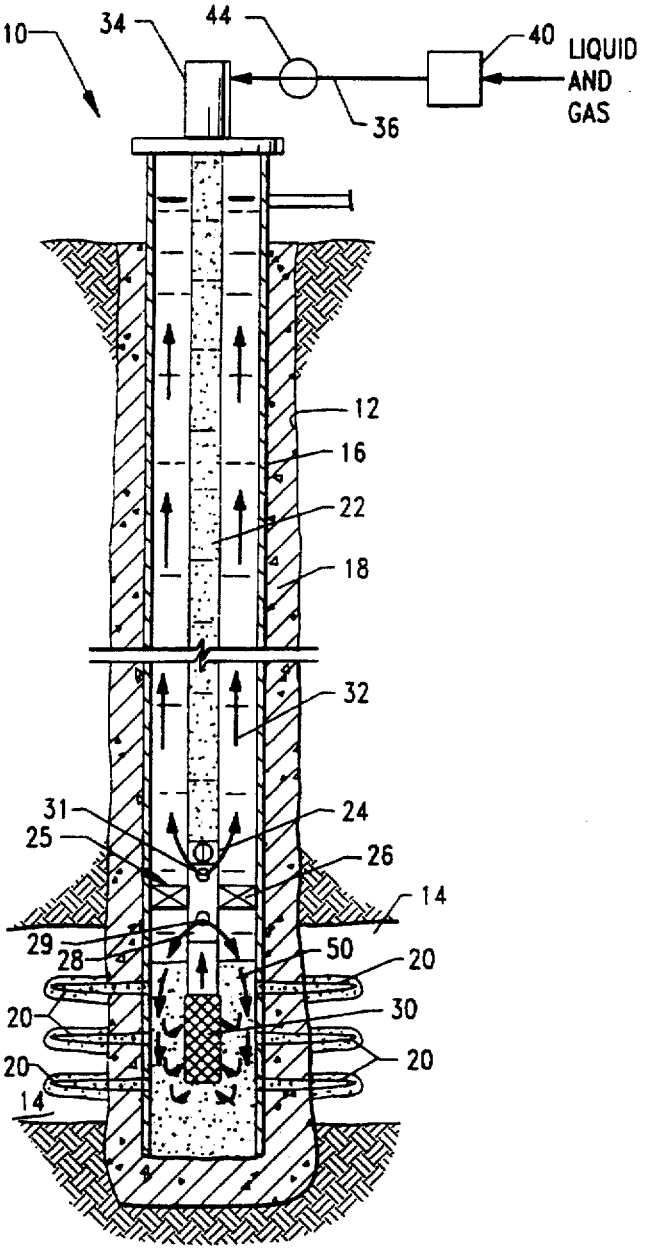
FIG. 4 is a schematic view of the well of FIG. 1 after a gravel pack has been formed in the well bore, perforations and formation.

As shown in FIG. 4, after the gravel blocking debris 46 has been removed, gravel suspended in a carrier liquid is pumped by the pump 40 through the conduit 36, the open valve 44, the well head 34, the work string 22, the open shut-off valve 24 and the ports 29 of the crossover 28 into the well 10 below the packer 26 to the bottom of the screen 30. The carrier liquid separates from the gravel as the carrier liquid flows through the screen 30. The separated carrier liquid flows through the crossover 28, and into and up the annulus 32 by way of the ports 31. When a gravel pack 50 has been formed in the well 10 below the packer 26, additional fluid pressure is applied to force the gravel into the perforations 20 and formation 14. Thus, as shown in FIG. 4, the gravel pack 50 is formed in the well 10, in the perforations 20 and in the formation 14 such that formation sand migrating with fluids produced from the formation 14 are separated from the fluids by the gravel pack 50.

Figure 5:
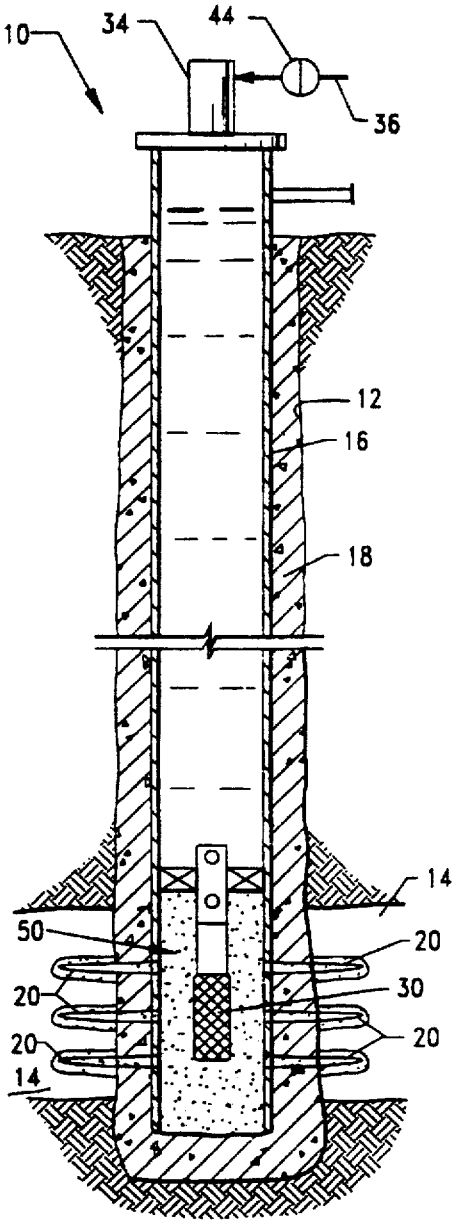
FIG. 5 is a schematic view of the well of FIG. 1 containing a gravel pack and sand screen after the work string has been removed.

Referring now to FIG. 5, once the gravel pack 50 has been formed and fluids have been reverse flowed out of the gravel pack 50 and out of the work string 22, the work string 22 and shut-off valve 24 are removed from the well 10 leaving the packer 26, crossover 28, sand screen 30 and gravel pack 50 therein.

Figure 6:
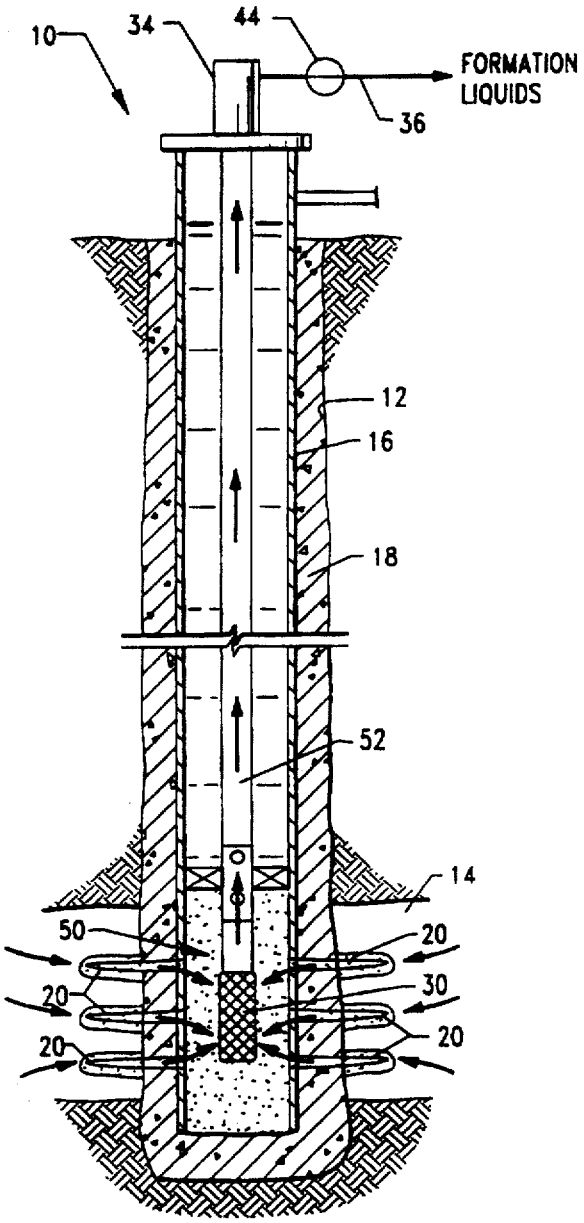
FIG. 6 is a schematic view of the well of FIG. 1 after a production string has been connected to the sand screen and the well has been placed on production.

Thereafter, as shown in FIG. 6, a production pipe string 52 is run into the well 10 and connected to the crossover 28. The well 10 is then produced by flowing fluids from the formation 14 through the gravel pack 50 and sand screen 30, whereby sand is separated from the fluids, upwardly through the production pipe string 52 and out of the well 10 by way of the well head 34, valve 44 and conduit 36.

As will now be understood by the those skilled in the art, the improved method of the present invention for forming a gravel pack in a well includes the step of pressurized fluid surging the well, perforations and formation after the work string and gravel pack forming tools have been placed in the well and the packer has been set. Gravel blocking debris contained in the well below the packer, in the perforations and in the formation are thus removed immediately prior to the formation of a gravel pack in the well, perforations and formation.

Thus, the present invention is well adapted to carry out the objects and advantages mentioned as well as those which are inherent therein. While numerous changes may be made by those skilled in the art, such changes are encompassed within the spirit of this invention as defined by the appended claims.

What is claimed is:

1. An improved method of forming a gravel pack in a well and in a subterranean formation penetrated by the well comprising the steps of:

(a) placing a pipe string in said well having a selectively operable shut-off valve and gravel pack forming tools comprising a packer, a crossover and a sand screen connected thereto, said crossover and sand screen being positioned below said packer and adjacent to said formation;

(b) setting the packer to seal the annulus between the well and the pipe string;

(c) introducing a pressurized fluid into said pipe string with said shut-off valve closed so that the pressure of the fluid in said pipe string is greater than the pressure of said formation;

(d) opening said shut-off valve so that said pressurized fluid surges into said well below said packer and into said formation thereby cleaning gravel blocking debris from said well and formation; and (e) introducing gravel below said packer into said well and said formation to form a gravel pack therein around said sand screen.

2. The method of claim 1 wherein said selectively operable shut-off valve is positioned at the lower end of said pipe string above said gravel pack forming tools.

3. The method of claim 1 wherein said shut-off valve is opened by movement of said pipe string.

4. The method of claim 1 wherein said shut-off valve is opened by fluid pressure exerted thereon.

5. The method of claim 1 wherein said pressurized fluid is at least partially comprised of a gas.

6. The method of claim 5 wherein said gas is selected from the group consisting of nitrogen, carbon dioxide and hydrocarbon gases.

7. The method of claim 1 wherein said pressurized fluid is comprised of gas and liquid.

8. The method of claim 7 wherein said gas is selected from the group consisting of nitrogen, carbon dioxide and hydrocarbon gases, and said liquid is selected from the group consisting of aqueous liquids and hydrocarbon liquids.

9. The method of claim 1 wherein said pressurized fluid is at least partially comprised of a gelled liquid.

10. The method of claim 9 wherein said gelled liquid contains gravel suspended therein.

11. An improved method of forming a gravel pack in a well and in a subterranean formation penetrated by the well, the well having casing cemented therein and perforations extending through the casing into the formation comprising the steps of:

(a) placing a work string in said well having a selectively operable shut-off valve and gravel pack forming tools comprising a packer, a crossover and a sand screen connected thereto, said crossover and sand screen being positioned below said packer and adjacent to said perforations extending into said formation;

(b) setting said packer to seal the annulus between said casing and the work string;

(c) introducing a pressurized fluid into said work string with said shut-off valve closed so that the pressure of the fluid in said work string is greater than the pressure of said formation;

(d) opening said shut-off valve so that said pressurized fluid surges into said well below said packer and into said formation by way of said perforations thereby cleaning gravel blocking debris from said well, perforations and formation;

(e) introducing gravel below said packer into said well, perforations and formation to form a gravel pack therein around said sand screen; and (f) removing said work string and shut-off valve from said well.

12. The method of claim 11 wherein said selectively operable shut-off valve is positioned at the lower end of said work string above said gravel pack forming tools.

13. The method of claim 11 wherein said shut-off valve is opened by movement of said work string.

14. The method of claim 11 wherein said shut-off valve is opened by fluid pressure exerted thereon.

15. The method of claim 11 wherein said pressurized fluid is at least partially comprised of a gas.

16. The method of claim 15 wherein said gas is selected from the group consisting of nitrogen, carbon dioxide and hydrocarbon gases.

17. The method of claim 11 wherein said pressurized fluid is comprised of gas and liquid.

18. The method of claim 17 wherein said gas is selected from the group consisting of nitrogen, carbon dioxide and hydrocarbon gases, and said liquid is selected from the group consisting of aqueous liquids and hydrocarbon liquids.

19. The method of claim 11 wherein said pressurized fluid is at least partially comprised of a gelled liquid.

20. The method of claim 19 wherein said gelled liquid contains gravel suspended therein.

* * * * *